US012241664B2

(12) United States Patent
Dunn et al.

(10) Patent No.: US 12,241,664 B2
(45) Date of Patent: Mar. 4, 2025

(54) HEAT PUMP WITH CORNER INTERFACE

(71) Applicant: Dandelion Energy, Inc., New York, NY (US)

(72) Inventors: John Dunn, New York, NY (US); Kathleen Hannun, New York, NY (US); Dung Duc Nguyen, New York, NY (US); Paul Ingemi, New York, NY (US)

(73) Assignee: DANDELION ENERGY, INC., New York, NY (US)

( * ) Notice: Subject to any disclaimer, the term of this patent is extended or adjusted under 35 U.S.C. 154(b) by 278 days.

(21) Appl. No.: 17/853,516

(22) Filed: Jun. 29, 2022

(65) Prior Publication Data

US 2024/0003600 A1 Jan. 4, 2024

(51) Int. Cl.

| | |
|---|---|
| ***F25B 30/06*** | (2006.01) |
| ***F25B 13/00*** | (2006.01) |
| ***F25B 30/02*** | (2006.01) |
| ***F25B 49/02*** | (2006.01) |

(52) U.S. Cl.

CPC ..... *F25B 30/06* (2013.01); *F25B 13/00* (2013.01); *F25B 30/02* (2013.01); *F25B 49/02* (2013.01); *F25B 2313/002* (2013.01)

(58) Field of Classification Search

CPC ..... F24F 1/56; F24F 3/001; F24F 1/22; F24F 13/20; F25B 13/00; F25B 30/02; F25B 49/02; F25B 2313/002

See application file for complete search history.

(56) References Cited

U.S. PATENT DOCUMENTS

| | | | | |
|---|---|---|---|---|
| 9,854,690 | B1 * | 12/2017 | Frye | H05K 7/1489 |
| 10,638,634 | B1 * | 4/2020 | Elsasser | H05K 9/0062 |
| 2003/0217563 | A1 * | 11/2003 | Wendt | F25B 39/04 62/298 |
| 2008/0112128 | A1 * | 5/2008 | Holland | H05K 7/20818 361/679.53 |
| 2015/0036287 | A1 * | 2/2015 | Ross | G06F 1/20 361/679.48 |
| 2017/0280593 | A1 * | 9/2017 | Magallanes | H05K 7/20818 |
| 2018/0031256 | A1 * | 2/2018 | Gillette | F24F 11/38 |
| 2020/0240664 | A1 * | 7/2020 | Al-Shibli | F25B 13/00 |
| 2020/0375011 | A1 * | 11/2020 | Tsibulevskiy | H02J 7/00036 |
| 2021/0396425 | A1 * | 12/2021 | Davtyan | F24F 1/029 |
| 2022/0397314 | A1 * | 12/2022 | Pickle | F25B 49/02 |

(Continued)

*Primary Examiner* — Henry T Crenshaw

(74) *Attorney, Agent, or Firm* — Fountainhead Law Group, PC

(57) ABSTRACT

A blower and heat exchanger component of a heat pump, includes physically moveable interface blocks located at the corners. The blocks are relocatable to different corner locations on the unit, to allow a same blower/heat exchanger component to adapt to an existing duct being located on either side (e.g., by installing the component rotated within the installation space as appropriate). Active interface block(s) moveable to different corners afford access to power connection and/or data connections and status display features. Blank blocks occupy the corner locations left vacant by relocation of active blocks to the side of the unit serving as the front for a particular installation. The moveable corner blocks afford access to the unit for power and data connection, and status display, irrespective of orientation as installed relative to an existing ducting layout of a building.

10 Claims, 9 Drawing Sheets

(56) References Cited

U.S. PATENT DOCUMENTS

| | | | | |
|---|---|---|---|---|
| 2023/0147346 | A1* | 5/2023 | Lingrey | F25B 30/02<br>165/48.1 |
| 2024/0003599 | A1* | 1/2024 | Dunn | F24F 1/56 |
| 2024/0003600 | A1* | 1/2024 | Dunn | F25B 13/00 |

* cited by examiner

TOP VIEW

TOP VIEW

TOP VIEW

HEAT PUMP WITH CORNER INTERFACE

BACKGROUND

Unless otherwise indicated herein, the approaches described in this section are not prior art to the claims in this application and are not admitted to be prior art by inclusion in this section.

Heat pumps are useful for many purposes. A prominent application for a heat pump is as a component for a Heating, Ventilation, and Air Conditioning (HVAC) system used to control ambient temperature within an environment. One example of such an environment is a residential or industrial building space.

SUMMARY

A blower and heat exchanger component of a heat pump, includes physically moveable interface blocks located at the corners. The blocks are relocatable to different corner locations on the unit, to allow for a same blower/heat exchanger component to adapt to an existing duct that is located on either side (e.g., by installing the component rotated within the installation space as appropriate). Active interface block (s) moveable to different corners afford access to power connection and/or data connections and status display features. Blank blocks occupy the corner locations left vacant by relocation of active blocks to the side of the unit serving as the front for a particular installation. The moveable corner blocks afford access to the unit for power and data connection, and status display, irrespective of orientation as installed relative to an existing ducting layout of a building.

DETAILED DESCRIPTION

Described herein are methods and apparatuses implementing an interface for a heat pump. In the following description, for purposes of explanation, numerous examples and specific details are set forth in order to provide a thorough understanding of embodiments according to the present invention. It will be evident, however, to one skilled in the art that embodiments as defined by the claims may include some or all of the features in these examples alone or in combination with other features described below, and may further include modifications and equivalents of the features and concepts described herein.

Figure 1:
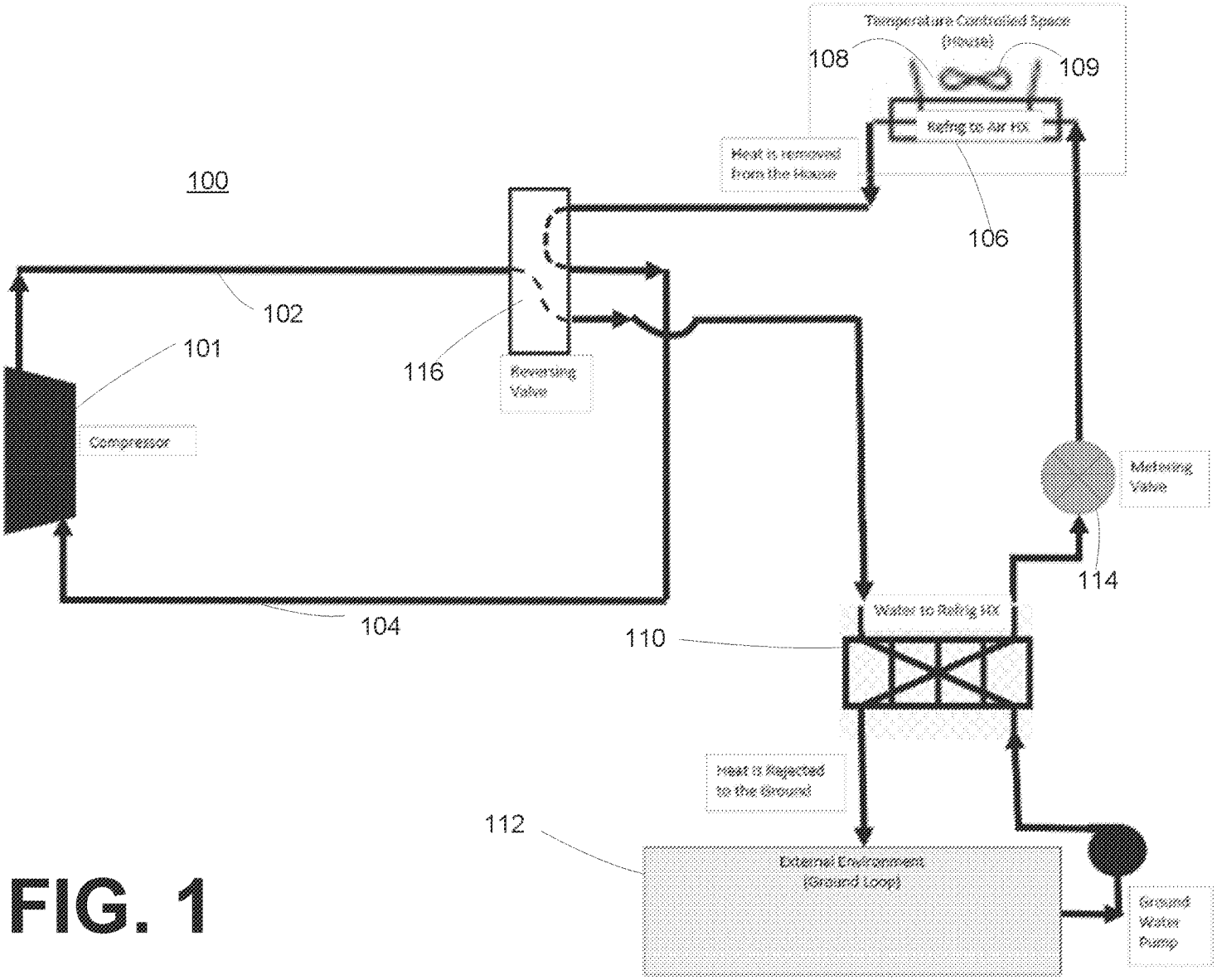
FIG. 1 shows a simplified view of a heat pump in a cooling mode of operation.
Figure 2:
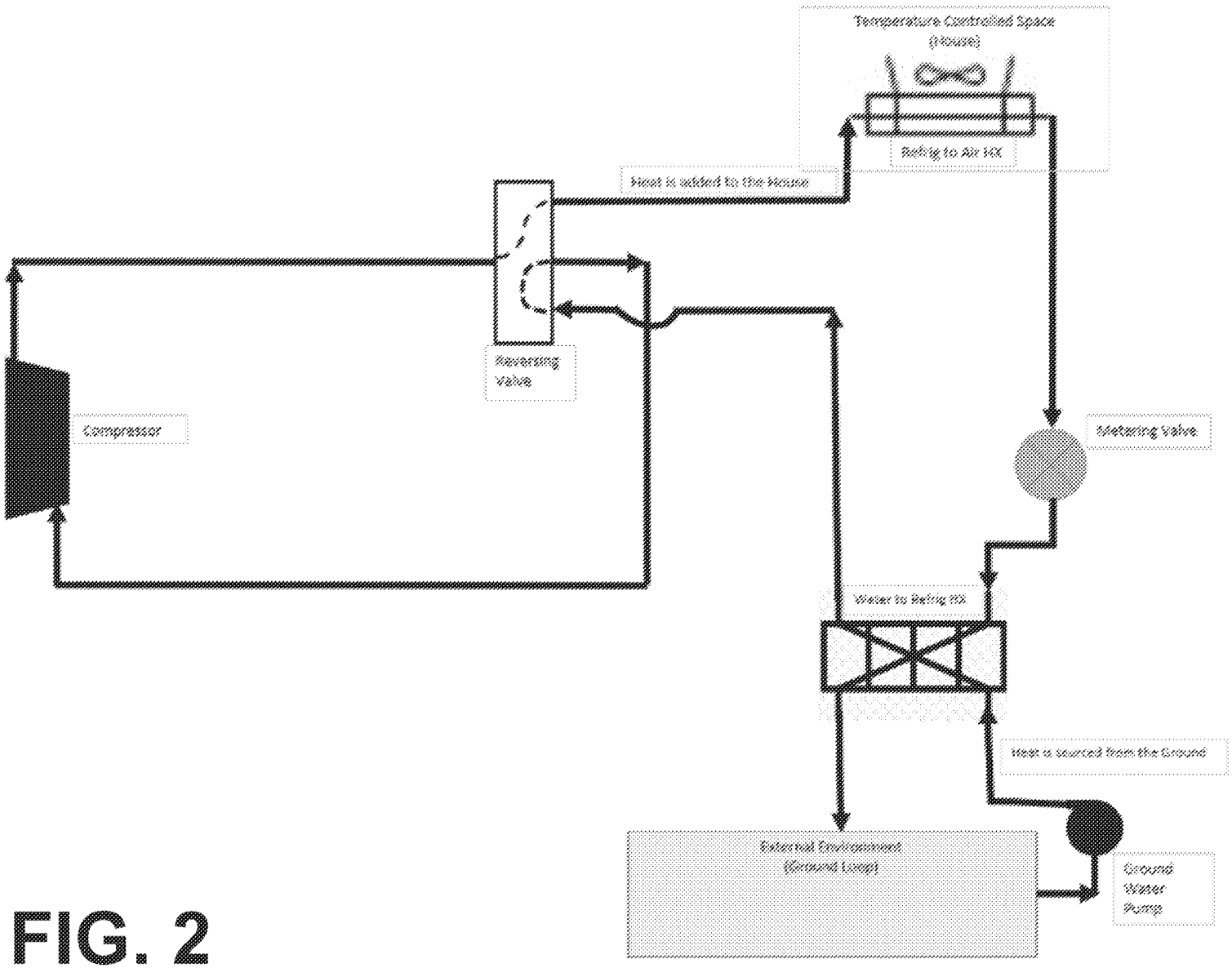
FIG. 2 shows a simplified view of a heat pump in a heating mode of operation.

FIG. 1 shows a simplified view of a ground source heat pump 100 in a cooling mode of operation. FIG. 2 shows a simplified view of a ground source heat pump in a heating mode of operation.

A heat pump may comprise the following five (5) elements.

1) A compressor 101 that moves working fluid (refrigerant) 102 through a circuit 104.
2) A primary side heat exchanger 106 that exchanges heat with the controlled temperature space 108.
3) A secondary side heat exchanger 110 that sources/sinks heat into the space 112 outside of the temperature controlled space.
4) A metering valve 114 which regulates the flow of refrigerant through the circuit.
5) A reversing valve 116 which changes the flow direction of refrigerant, allowing the circuit to extract or add heat to the temperature controlled space.

FIGS. 1-2 show a ground source heat pump, where the space outside of the temperature controlled space is the ground. However, other types of heat pumps are possible, for example air-source heat pumps where the space outside of the temperature controlled space is the air of the surrounding environment.

One particular type of heat pump includes a blower 109 and an air-to-refrigerant heat exchanger. That heat exchanger controls temperature in the space by recirculating air through ducting to/from the temperature-controlled interior space and through the heat pump.

Such a heat pump can add or remove heat from this airflow to provide any desired air temperature setpoint inside the temperature-controlled interior space.

Figure 3:
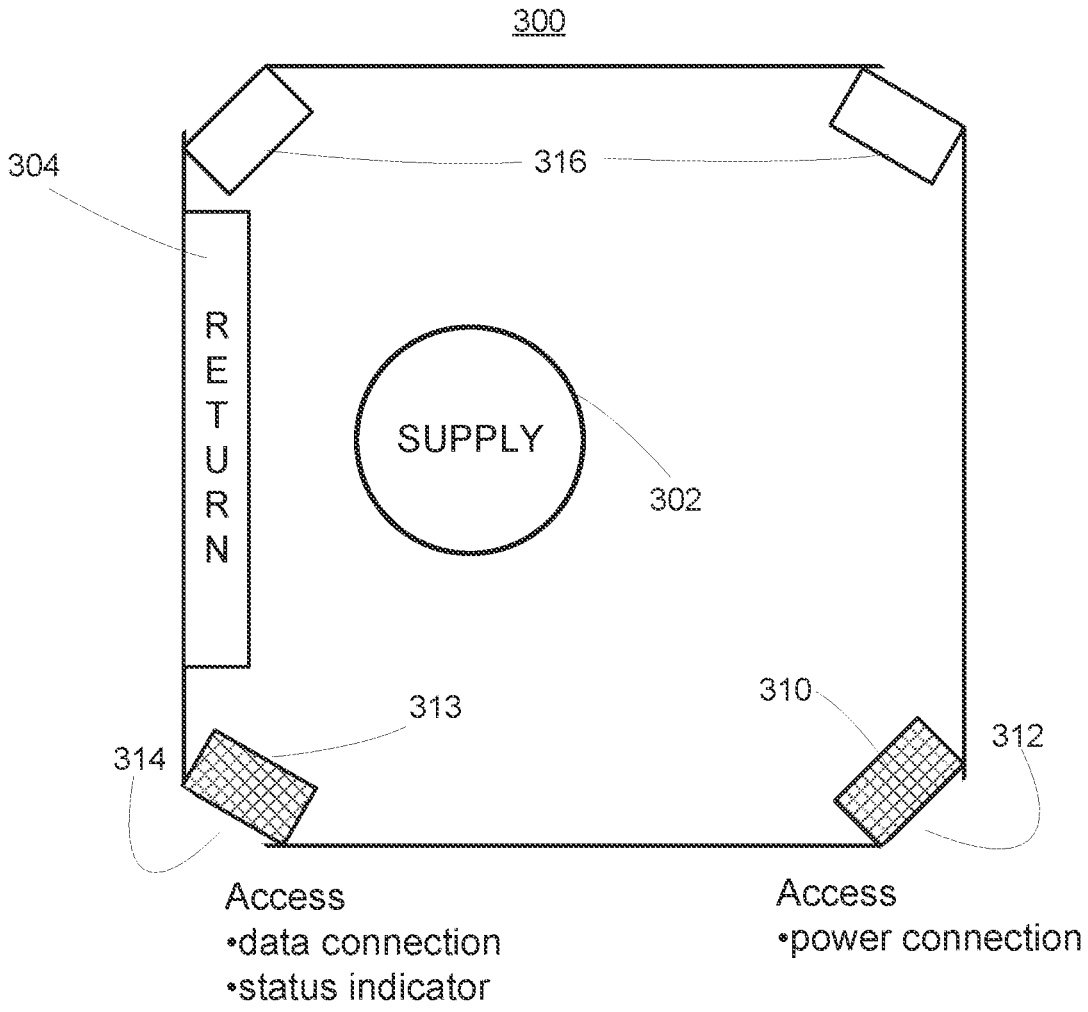
FIG. 3 shows a simplified top view of a heat pump component according to an embodiment.

FIG. 3 provides a simplified top view of a heat pump component 300 comprising a blower and a heat exchanger. This type of heat pump has a supply 302 air duct and a return 304 air duct. The supply duct provides temperature controlled airflow to the temperature controlled space.

The return duct accepts airflow back from the temperature controlled space. This allows the heat pump to add or remove heat before sending it back to the temperature controlled space via the supply duct.

The orientation and location of the supply and return ducts in buildings are not standardized. One configuration is to have the supply duct positioned so that the supply airflow comes out vertically from the top of the unit, with the return duct located at one side.

Figure 7:
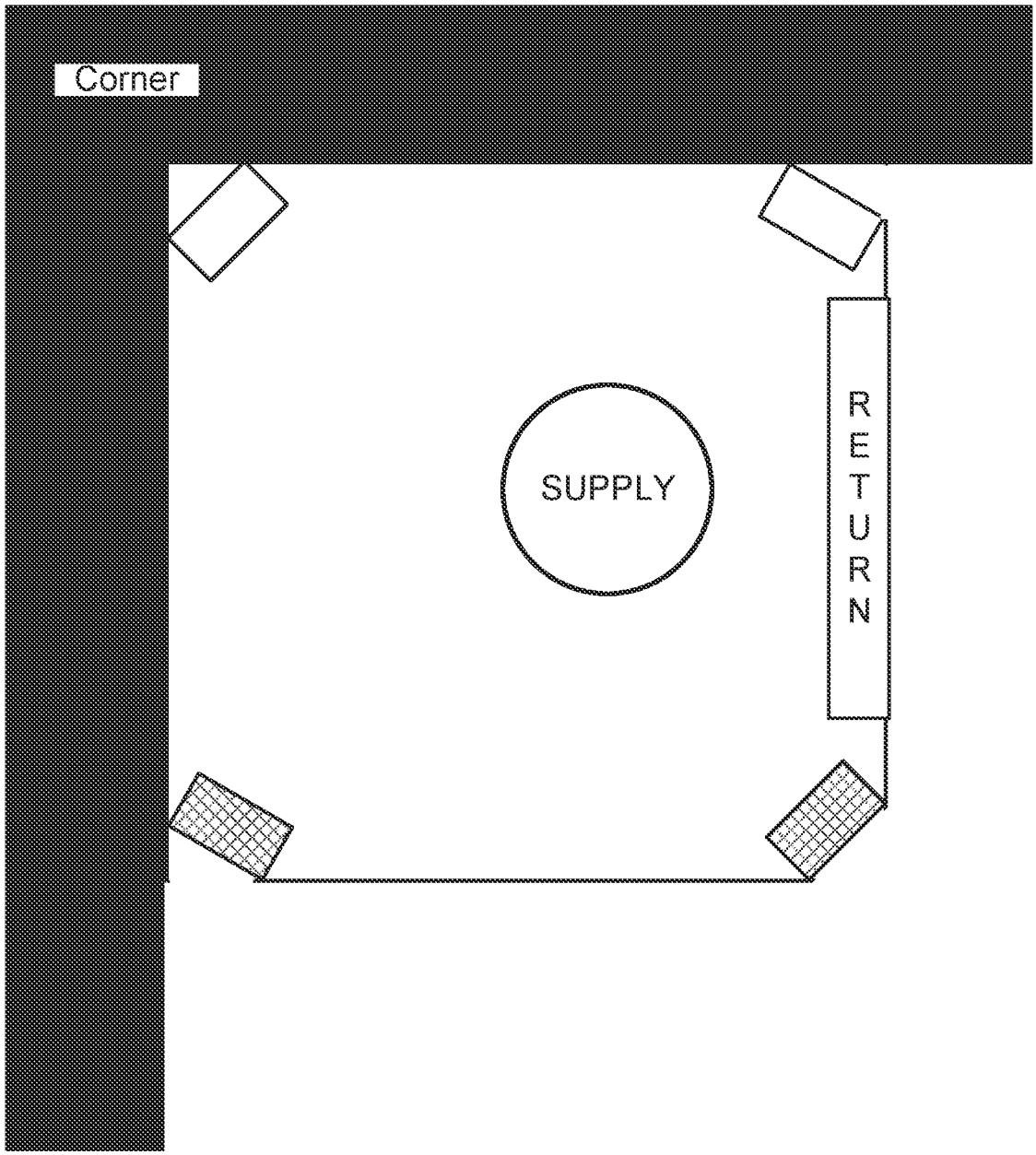
FIG. 7 shows a top view of an embodiment of a heat pump component deployed in a left hand corner.

Embodiments provide a heat pump component that is designed to allow for deployment in the particular location that is dictated by the layout of ducting within a building. For example, the heat pump component could be deployed in a left hand corner, with the return duct present on the right hand side (as shown in FIG. 7).

Figure 4:
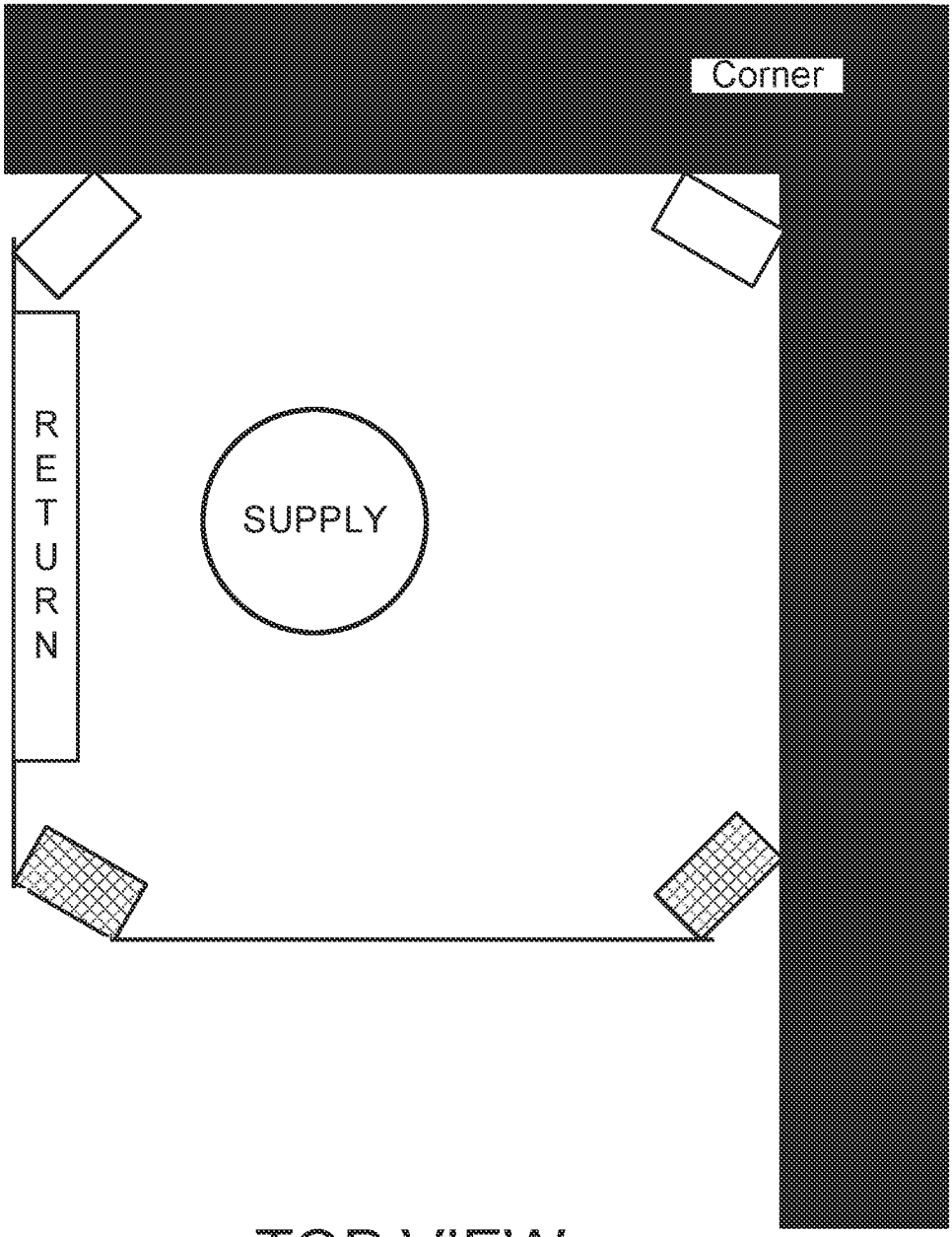
FIG. 4 shows a top view of an embodiment of a heat pump component deployed in a right hand corner.

Alternatively, the same heat pump component design could be deployed in a right hand corner. There, simply rotating (e.g., by 180°) the unit affords the return duct on the left hand side, as shown in FIG. 4. According to such embodiments, depending upon the deployment either of the sides orthogonal to the right or left side, could actually serve as the front of the unit (e.g., facing a user).

To allow this, moveable block(s) are provided at corners of the unit, offering power connection and/or data connections and status display features. By relocating the blocks to different corners of the unit prior to installation, connection access to power and data, and for status display, are available to a user irrespective of the particular deployment of the unit. Blank blocks may also be provided to occupy the corner locations left vacant by relocation of active blocks to the side of the unit serving as the front for a particular installation.

Thus, in the particular embodiment of FIG. 3 the heat pump comprises a first active corner block 310 that is moveably mounted at a first corner 312. This first corner block may offer a power connection and a rotatable switch.

The heat pump also comprises a second active corner block 313 that is moveably mounted at a second corner 314. This second corner block may offer data connection(s) and status indicator(s) accessible to a user.

As mentioned herein, the active blocks are moveable to different corners depending upon the particular installation. Accordingly, the unit further comprises two blank corner blocks 316 to occupy the locations left vacant by active blocks that have been relocated to different corners.

Figure 5:
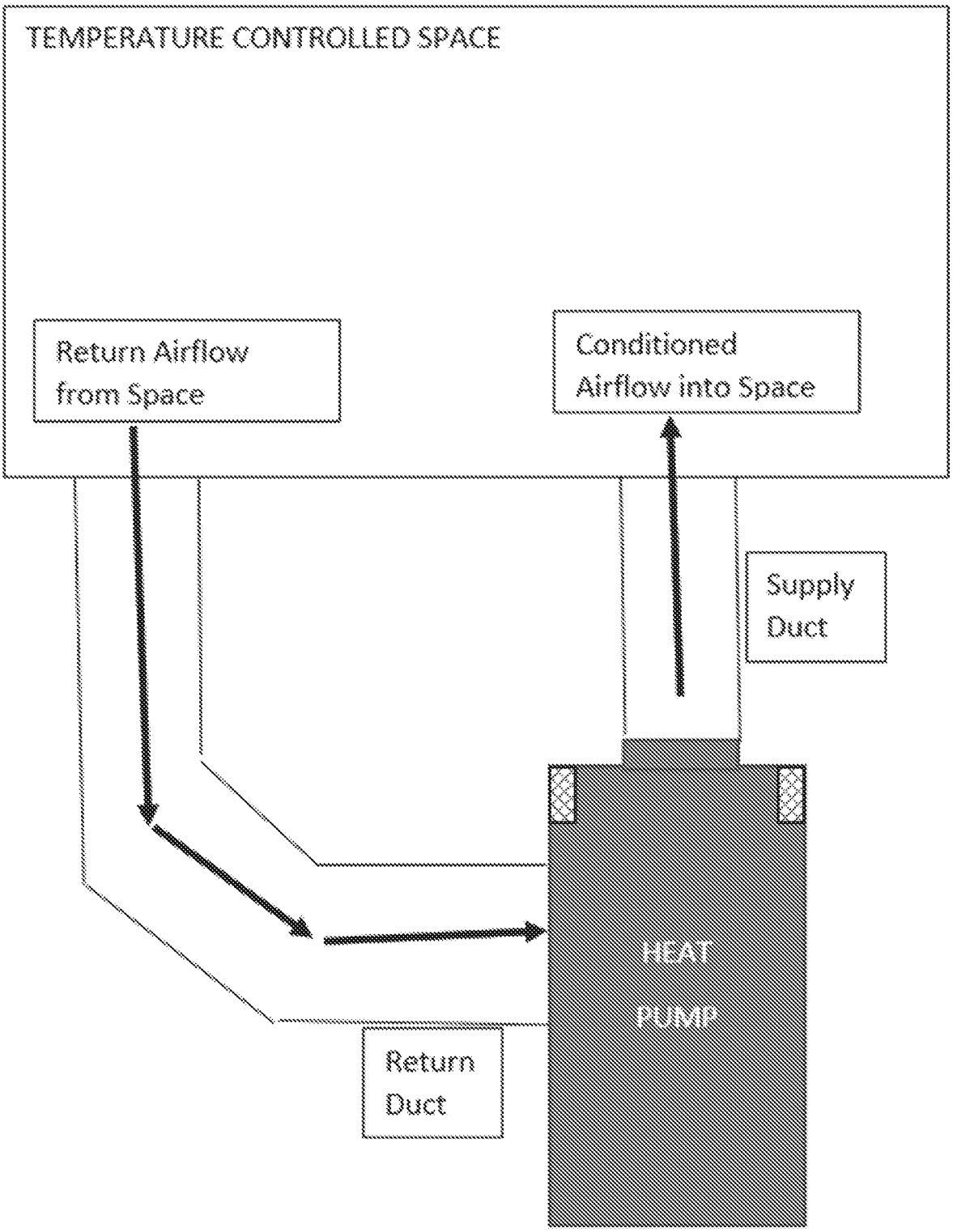
FIG. 5 shows a side view of a heat pump component in FIG. 4.

FIG. 4 shows a top view of an embodiment of a heat pump component deployed in a right hand corner. FIG. 5 shows a side view of a heat pump component in FIG. 4.

Figure 6:
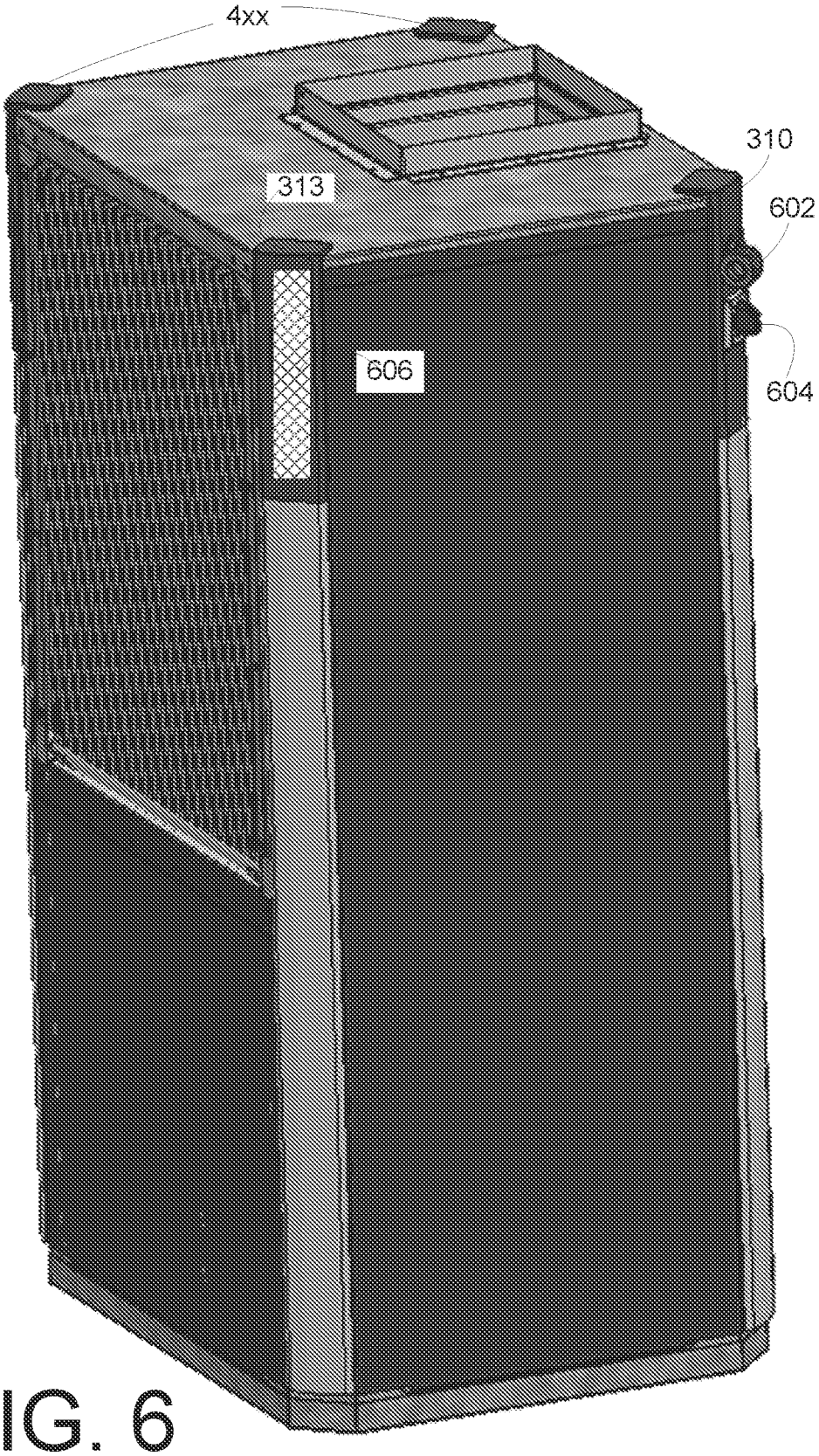
FIG. 6 shows a side perspective view of a heat pump component in FIG. 6.

FIG. 6 shows a side perspective view of a heat pump component in FIG. 4. First active block 310 affords power connection 602 and switch 604. Second active block 313 affords data connection and status indicators 606. The other corner blocks are blanks.

To realize access for electrical power, data, and status indication, from either side of the unit as installed, the design approach allows movement of the blocks to different corners. This permits assignment of either side of the unit as the front.

The unit can then be positioned according to the ducting requirements right or left airflow return. Assignment of the front is no longer required from a perspective of electrical connection, signal, or display perspective.

Figure 8:
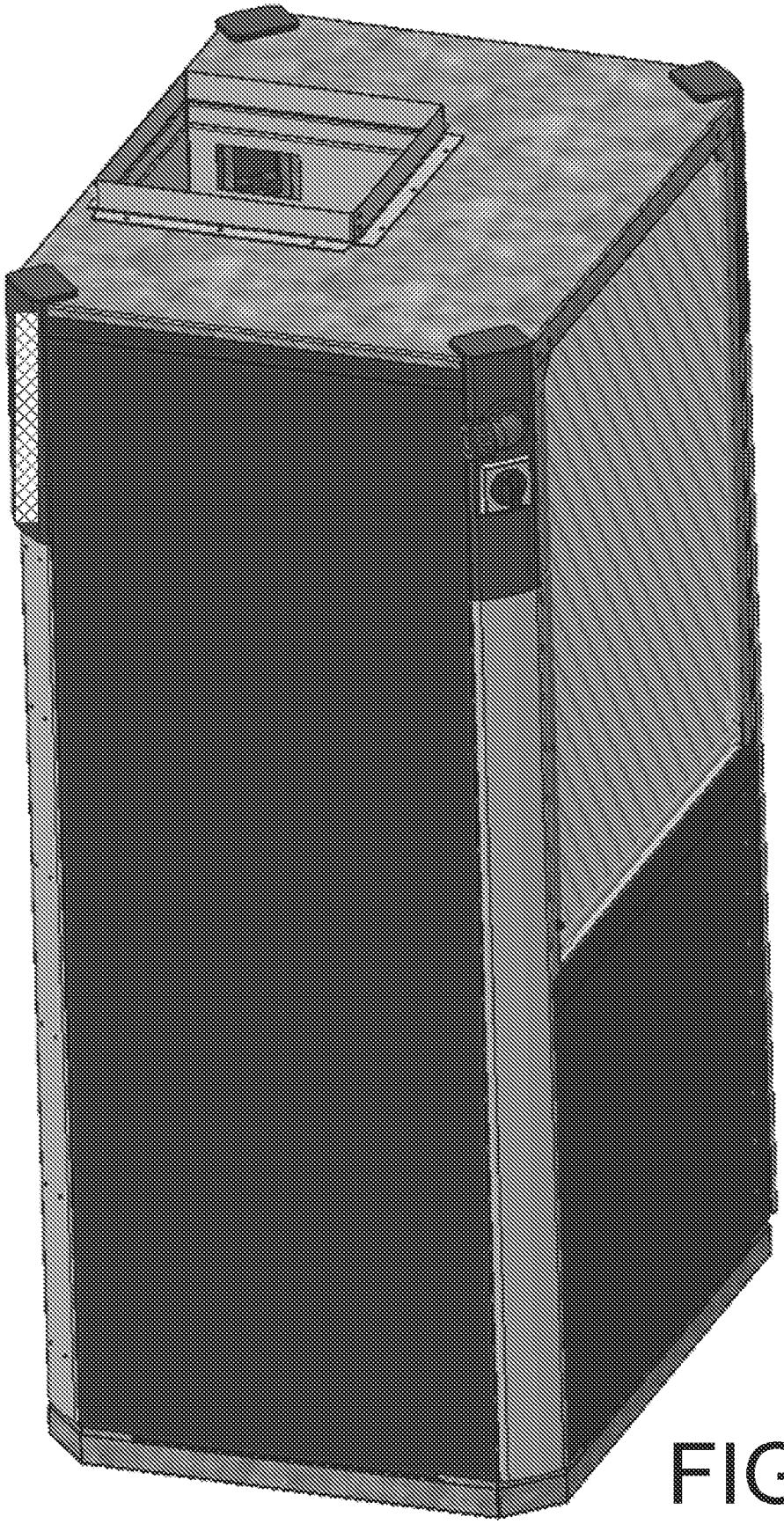
FIG. 8 shows a side perspective view of a heat pump component in FIG. 6.

FIG. 7 shows a top view of an embodiment of a heat pump component deployed in a left hand corner. FIG. 8 is a side perspective view of a heat pump component in FIG. 7.

Figure 9:
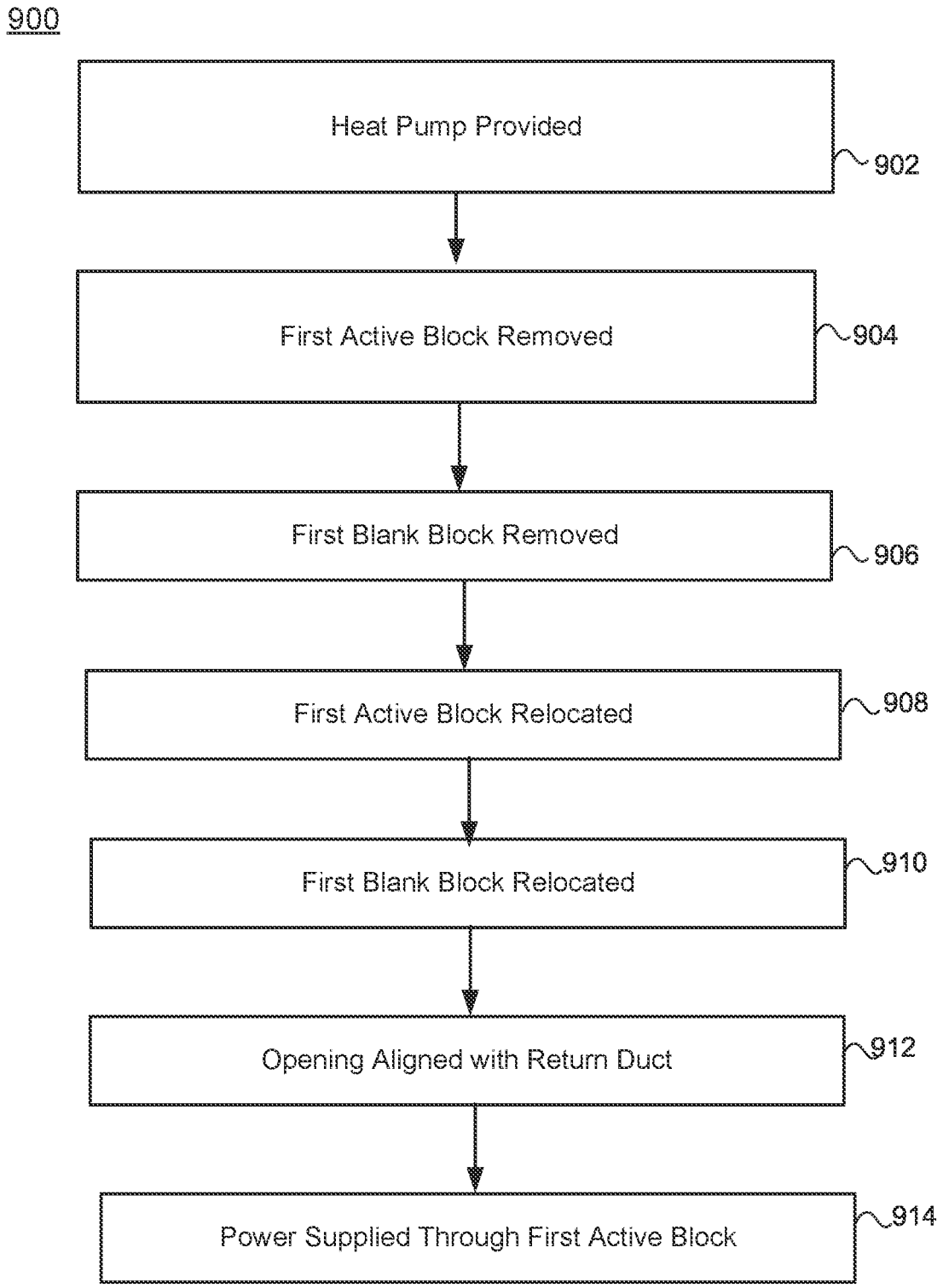
FIG. 9 shows a simplified flow diagram of a method according to an embodiment.

FIG. 9 shows a simplified flow diagram of a method according to an embodiment. At 902, a heat pump unit is received.

At 904, a first active corner block is removed from a first corner; At 906 a first blank corner block is removed from a second corner.

At 908 the first active corner block is relocated to the second corner. At 910 the second corner active block is relocated to the first corner.

At 912 an opening in the heat pump unit is aligned with a return duct. At 914 power is supplied through the first active block.

The above description illustrates various embodiments of the present invention along with examples of how aspects of the present invention may be implemented. Other embodiments are possible.

For example, while the above description describes an embodiment where active interfaces are allocated as between two different relocatable blocks (with the remaining other two blocks being blanks), this is not required. According to alternative embodiments, all features (e.g., power connection, data connection, status indicators) could be consolidated in a single moveable active block, with the remaining three blocks being moveable blanks.

The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. A method comprising:

relocating a first active corner block of a heat pump from a first corner to a second corner;

relocating a first blank corner block of the heat pump from the second corner to the first corner;

rotating the heat pump to align a first opening in a first side to a return duct, the first opening in fluid communication with a blower and in thermal communication with a heat exchanger; and providing a power connection through the first active corner block.

2. A method as in claim 1 further comprising aligning a second opening defined in a top side to a supply duct.

3. A method as in claim 1 further comprising:

relocating a second active corner block of the heat pump from a third corner to a fourth corner; and providing a data connection through the second active corner block.

4. A method as in claim 1 wherein the first active corner block further comprises at least one of a data connection and a status indicator.

5. A method as in claim 1 further comprising placing a second opening defined in a top side into fluid communication with a supply duct.

6. A method as in claim 1 wherein the heat pump comprises a heat exchanger.

7. A method as in claim 6 wherein the heat exchanger is in thermal communication with a ground loop.

8. A method as in claim 1 wherein the heat pump comprises a compressor.

9. A method as in claim 1 wherein the heat pump comprises a reversing valve.

10. A method as in claim 1 wherein the heat pump comprises a metering valve.

* * * * *